US006123144A

United States Patent [19]

Morman et al.

[11] Patent Number: 6,123,144

[45] **Date of Patent: *Sep. 26, 2000**

[54] INTEGRATED HEAT EXCHANGER AND EXPANSION TANK

[75] Inventors: Jeff J. Morman, Greenwood, Ind.; Lloyd Morley; Mike J. Andrie, both of Charleston, S.C.

[73] Assignee: Cummins Engine Company, Inc., Columbus, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/834,216

[22] Filed: Apr. 15, 1997

[51] Int. Cl.[7] ..... F28D 15/00

[52] U.S. Cl. ..... 165/104.32; 165/41; 165/51; 165/917; 123/47.54

[58] Field of Search ..... 165/132, 104.32, 165/73, 74, 75, 81, 71, 917, 104.27, 41, 51, 158, 174, 111; 123/41.54

[56] References Cited

U.S. PATENT DOCUMENTS

| | | | |
|---|---|---|---|
| 2,513,124 | 6/1950 | Weiks . | |
| 2,522,948 | 9/1950 | Hoffman | 165/132 |
| 2,729,430 | 1/1956 | Sieder et al. | 165/132 |
| 3,132,690 | 5/1964 | Suchomel | 165/917 X |
| 3,254,707 | 6/1966 | Ferguson | 165/104.23 X |
| 3,572,984 | 3/1971 | Jones . | |
| 3,804,161 | 4/1974 | Nowak . | |
| 4,011,905 | 3/1977 | Millard . | |
| 4,047,563 | 9/1977 | Kurata | 165/917 X |
| 4,116,268 | 9/1978 | Kruger | 165/111 |
| 4,175,616 | 11/1979 | Pabst et al. | 165/107 |
| 4,200,065 | 4/1980 | Buddenhagen | 123/41.54 |
| 4,228,845 | 10/1980 | Cowling | 165/132 X |
| 4,289,507 | 9/1981 | Cadars et al. | 165/104.32 X |
| 4,366,858 | 1/1983 | Moranne | 165/104.32 |
| 4,422,502 | 12/1983 | Villeval . | |
| 4,491,174 | 1/1985 | Villeval . | |
| 4,512,396 | 4/1985 | Villeval . | |
| 4,589,478 | 5/1986 | Wunder | 165/917 X |
| 4,747,446 | 5/1988 | Polidori et al. . | |
| 5,289,803 | 3/1994 | Matsushiro et al. | 123/41.1 |
| 5,314,009 | 5/1994 | Yates et al. . | |
| 5,746,270 | 5/1998 | Schroeder et al. | 165/917 X |

FOREIGN PATENT DOCUMENTS

| | | | |
|---|---|---|---|
| 0219419 | 4/1987 | European Pat. Off. | 165/104.32 |
| 0290339 B1 | 9/1990 | European Pat. Off. . | |
| 2492514 | 10/1980 | France . | |
| 2535838 | 11/1982 | France . | |
| 2741353 | 3/1979 | Germany | 165/104.32 |
| 3021918 | 12/1980 | Germany | 165/104.32 |
| 3916780 | 2/1990 | Germany | 165/917 |
| 0107887 | 8/1980 | Japan | 165/917 |
| 2122736 | 1/1984 | United Kingdom . | |
| WO 93/06365 | 4/1993 | WIPO . | |

*Primary Examiner*—Christopher Atkinson
*Attorney, Agent, or Firm*—Leydig, Voit & Mayer, Ltd.

[57] ABSTRACT

A combination heat exchanger and expansion tank are provided having an integral housing with a self-de-aerating design. Particularly suitable for cooling marine internal combustion engines, the housing holds an elongated heat exchanger core configured with at least one straight seawater passage, such that an embodiment of the housing facilitates access to opposite passage ends for cleaning through respective openings in the housing, eliminating a need to remove the core. The housing forms an upper expansion chamber, a lower collection chamber, and a coolant channel in communication with these chambers. The coolant channel receives and directs a main flow of engine coolant over the core; the coolant flow subsequently dropping into the lower collection chamber, from where the coolant exits for recirculation through the engine. The upper expansion chamber includes vents which receive vented coolant flow from remote engine components. This vented coolant flow is de-aerated in the expansion chamber, and the vented liquid coolant passes downwardly to the channel for recirculation. The housing is configured so that the vapor bubbles in the coolant channel are upwardly directed to de-aerate from the coolant in the expansion tank.

20 Claims, 2 Drawing Sheets

INTEGRATED HEAT EXCHANGER AND EXPANSION TANK

BACKGROUND OF THE INVENTION

The present invention generally relates to a heat exchanger for an internal combustion engine. More specifically, the invention relates to an integrated heat exchanger and expansion tank for cooling a marine engine.

Liquid-cooled internal-combustion engines for marine applications usually utilize a heat exchanger wherein heat is transferred from liquid engine coolant to seawater. Facilitating this thermal exchange is a heat exchanger core comprised of one or more seawater tubes through which seawater is continually passed. The engine coolant is directed to flow externally over the core, so that heat from the coolant is absorbed into the cooler seawater. Coolant is then recirculated through a coolant circuit to cool the engine block, and in certain applications, to cool a turbocharger and/or exhaust manifold.

Vapor and air bubbles sometimes emerge in the liquid coolant of a cooling system. The vapor tends to rise and collect at certain locations, if permitted. The presence of vapor and air in the cooling circuit undesirably reduces the thermal exchange capacity at the vacinity of trapped vapor. Therefore, it is desirable to de-aerate the liquid coolant in the heat exchanger so that any vapor and air bubbles are collected and removed from the cooling circuit. Additionally, it is desirable to "vent" vapor pockets from remote locations of the cooling circuit.

A conventional cooling system usually includes an expansion chamber containing a volume of air in communication with the cooling circuit. This permits volume variations in the liquid coolant without overpressurizing or damaging the system. Ideally, vapor and air from the cooling circuit are collected at the expansion chamber. An expansion chamber may additionally function as a make-up reservoir, containing extra coolant to compensate for coolant losses in the system.

Conventional cooling systems typically include separate, discrete heat exchanger and expansion tank components. These discrete components must be connected in fluid communication with each other by hoses, hose clamps and tubing. Moreover, a separate coolant collection reservoir tank is sometimes provided in conventional systems as a third additional component which must likewise be connected with hoses and mounted to the engine. Unfortunately, these conventional arrangements are susceptible to failure of the hoses or leakage at the clamped hose connections. Furthermore, the separate heat exchanger, expansion tank, and collection reservoir tank components are known to inconveniently obstruct other engine parts due to their bulky nature, and additionally give the engine an aesthetically unpleasing bulky or cluttered appearance.

Engine rooms or engine bays in boats are usually confined spaces. Accordingly, a compact engine design is desirable in order to maximize space surrounding the engine in an existing engine compartment, or in order to minimize engine compartment size.

Over time and use, a marine heat exchanger core accumulates debris from the seawater, requiring cleaning to optimize heat conduction and water flow. Cleaning of the core tubes is typically performed by a process known as "rodding" in which a rod-like tool is manually inserted through the tubes, pushing any debris through the tubes. Unfortunately, conventional marine heat exchangers are difficult to clean because of inadequate access. In conventional heat exchangers, the core must be removed from the heat exchanger housing in order to permit "rodding" of the seawater tubes.

More specifically, a conventional core is provided as a unit with a header cap mounted at one end for porting seawater flow to and from the core interior. This core is inserted through a single opening into the heat exchanger housing, the core being mounted in position by securing the header cap over the housing opening. Access to the core interior for cleaning requires that the header cap first be disassembled from the housing, withdrawing the core from the housing with the header cap attached, and removing the header cap from the core. This is disadvantageous, because removal of the core exposes the engine coolant side of the cooling system, draining the engine coolant from the heat exchanger and risking contamination of the housing interior with debris. Moreover, in many instances, withdrawal of the core from the heat exchanger housing may be impossible in the field due to obstruction by an engine component or engine room wall. Therefore, a heat exchanger design is needed which permits "rodding" of the core without removing the core from the housing.

SUMMARY OF THE INVENTION

An improved engine cooling apparatus is provided by the present invention, which, in an embodiment, provides a combination heat exchanger and expansion tank formed within an integral housing. This device is preferably adapted for use in a marine internal combustion engine. The integral housing design reduces the number of parts, provides a compact and space-efficient design and eliminates the previously-required hoses connecting the expansion tank to the heat exchanger housing. Preferably, the present invention further includes a lower coolant collection chamber formed within the same integral housing.

Additionally, an embodiment of the invention provides that the expansion tank has vent openings which receive "vent" flow diverted from parts of the cooling circuit which are particularly susceptible to collecting vapor. In particular, coolant is vented from the turbocharger and/or the exhaust manifold portions of the cooling circuit by routing a vent tube from each such component to the vents in the expansion tank.

The integral heat exchanger and expansion tank housing is preferably made of aluminum, and the heat exchanger core is preferably made of a copper-nickel alloy.

Another embodiment of the invention provides a de-aerating design by which coolant is channeled around the heat exchanger core, liquid coolant dropping into the lower collection chamber, while vapor rising upwardly through the channel and collecting in the expansion chamber. The expansion chamber is defined by vertical side walls which help to de-aerate bubbles from the coolant therein.

Additionally, an embodiment of the invention provides greater serviceability by mounting the core in an end-to-end manner between two openings in the housing. Through these openings, an interior of the core can be accessed from opposite ends so that the seawater passages within the core may be cleaned without removal of the core from the housing.

An advantage of the present invention is that it provides an improved engine cooling device which combines a heat exchanger and an expansion tank into an integral housing.

Another advantage of the present invention is that it eliminates hose connections between the expansion tank and heat exchanger, thereby eliminating hose failure or leakage.

A further advantage of the present invention is that it provides a means for de-aerating coolant in a heat exchanging system.

Still another advantage of the present invention is that it provides a marine engine heat exchanger having improved serviceability. In particular, each end of the heat exchanger core is accessible from respective capped openings such that the core's interior may be "rodded" without removing the core from the housing. This is particularly advantageous in confined engine compartments where space does not permit withdrawal of the core from the housing. A related advantage of this embodiment is that the engine coolant side of the cooling system is undisturbed by the present invention because only the core's interior is exposed when the caps are removed; the exterior coolant side of the core is not exposed when the caps are removed.

Additional features and advantages of the present invention are described in, and will be apparent from, the detailed description of the preferred embodiments and from the drawings.

DETAILED DESCRIPTION OF THE DRAWINGS

Figure 1:
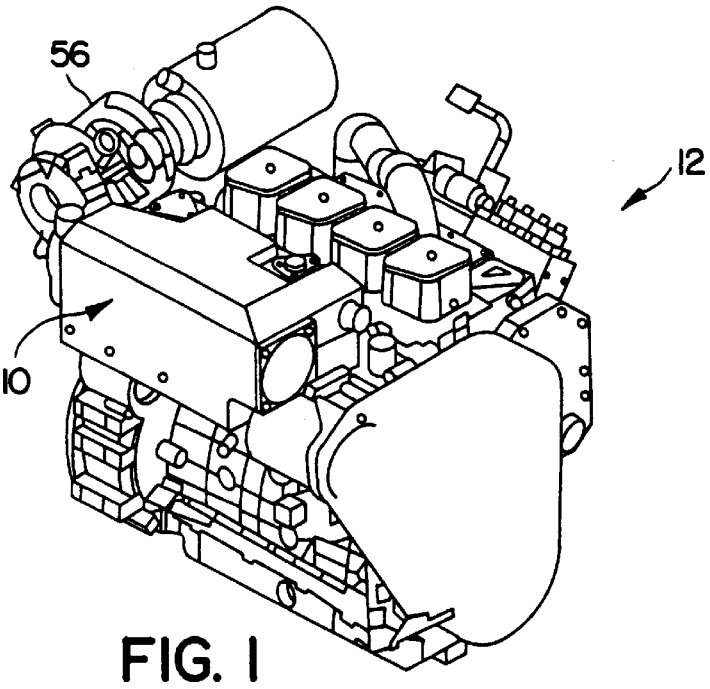
FIG. 1 is an isometric view of an internal combustion engine having a combination heat exchanger and expansion tank according to an embodiment of the invention.

Now referring to the Figures, wherein like numerals designate like parts, FIG. 1 illustrates an integrated heat exchanger and expansion tank device 10 according to an embodiment of the invention, mounted to an engine 12. In particular, the engine 12 shown is a marine diesel engine. The device 10 is connected to the cooling circuit of the engine 12 (consisting of flow cavities within cooling jackets, etc.). As shown in FIG. 1, the device 10 is neat, compact, conveniently located on the engine and is an aesthetically pleasing engine component.

Figure 2:
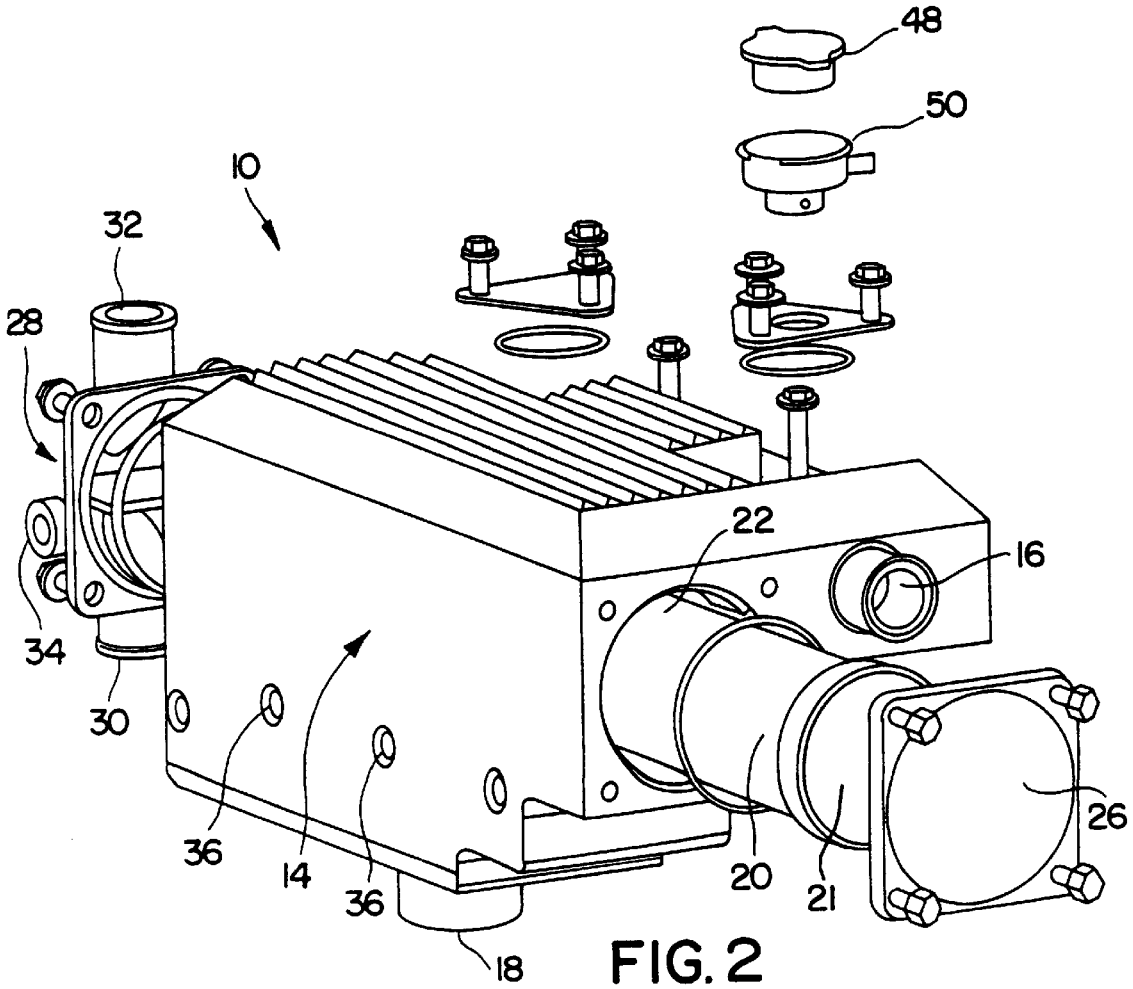
FIG. 2 is an exploded isometric view of the combination heat exchanger and expansion tank according to an embodiment of the invention, showing the heat exchanger core and other parts.

The exploded view of FIG. 2 shows the device 10 in greater detail. The device 10 includes an integral housing 14, which is preferably made of aluminum. The housing 14 has an interior which is described below in connection with FIGS. 3–5. Still referring to FIG. 2, the housing 14 includes a main inlet duct 16 which receives coolant from the engine 12, and an outlet duct 18, from which coolant returns to the engine 12.

Figure 4:
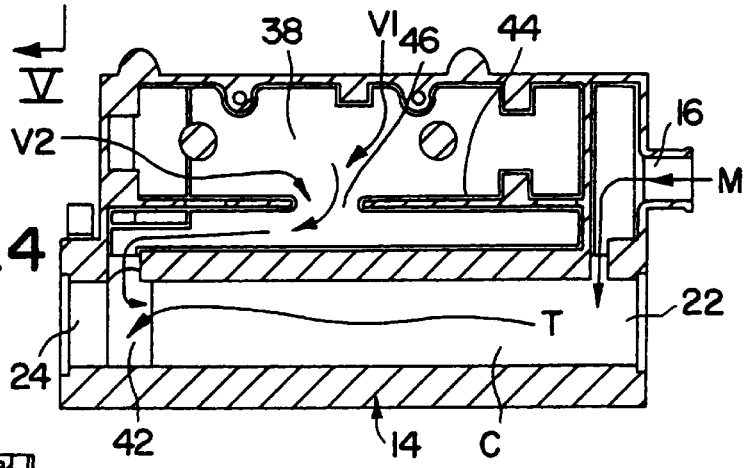
FIG. 4 is a plan section of the integral housing of FIG. 3, taken generally along line IV—IV of FIG. 3 through the expansion chamber.

Also illustrated in FIG. 2 is a heat exchanger core 20 mountable within the housing. As shown, the heat exchanger core 20 is generally cylindrical and defines an interior forming one or more straight seawater passage 21. The core 20 is preferably made of a copper and nickel alloy for its corrosion resistance and thermal conduction properties. The core 20 is approximately the same length as the housing 14, and the core 20 is mountable between a first opening 22 and a second opening 24 (FIG. 4). The interior of the core 20 is accessible through each of the opposite openings 22, 24, however, the ends of the core 20 are circumferentially sealed against the housing 14.

A first cap 26 and second cap 28 are sealably securable over the first and second openings, 22, 24, respectively. As illustrated, the second cap 28 is a header member having seawater inlet port 30 and a seawater outlet port 32 which direct seawater respectively into and out of the seawater passages 21 within the core 20. The second cap 28 includes a zinc electrode 34 (known in the art as a "sacrificial lamb") which is expendably corroded by the seawater in lieu of the core 20.

FIG. 2 further illustrates a plurality of transverse bolt tubes 36 which extend through the housing 12. These accommodate bolts (not shown) for mounting the device 10 to the engine 12.

Turning to FIGS. 3–6, the integral housing 14 has an interior having a de-aerating design. An expansion chamber 38 is formed in an upper portion of the integral housing 14, and a coolant reservoir or collection chamber 40 is formed in a lower portion of the housing 14. The upper expansion chamber 38 and lower collection chamber 40 are in fluid communication with each other via a coolant channel C formed within the housing 14. A portion of the channel C is a cylindrical space (see FIGS. 2, 4, and 5) which substantially surrounds an exterior of the core 20 in a coaxial manner (FIG. 2) between the ends of the core.

The device 10 has a compact design because the expansion chamber 38, collection chamber 40, and heat exchanger core 20 are all contained within the integral housing 14. Moreover, because fluid communication is facilitated among these by the channel C formed within the housing 14 as described below, no conventional hose connections are needed between these co-housed elements.

Coolant flows through the device 10 as follows. Referring to FIG. 4, a main coolant flow, indicated by an arrow M, arrives from the engine through the main inlet duct 16. This main flow M enters the channel C adjacent to the core 20, generally at a front end of the core 20. The coolant then travels through the cylindrical portion of the channel C along an exterior of the core 20, as indicated by the flow arrow T. The thermal transfer of the coolant occurs along the flow T, where the heat is transferred through the core 20 into to the seawater passing through the core's interior.

Figure 5:
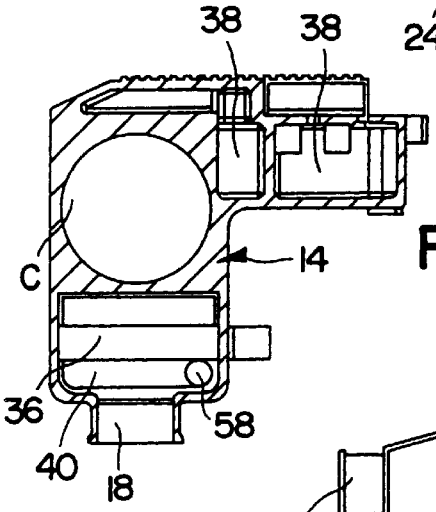
FIG. 5 is a front section of the integral housing of FIG. 3, taken generally along line V—V of FIG. 3.

Still referring to FIG. 4, a the channel C includes a passage 42 located below the core. This passage 42 is positioned near an opposite end of the coolant inlet duct 16 so that the coolant flow T extends substantially along the length of the core for maximum cooling. The reduced-temperature coolant drops through the passage 42 into the collection chamber 40 (FIG. 5).

Vapor bubbles which might be present in the coolant flow T tend to rise in the channel C, entering a portion of the channel C which leads to the expansion chamber 38, as shown in FIG. 4. Thus, the channel C is configured to guide any such vapor bubbles into the expansion chamber 38, where the coolant is de-aerated so that the vapor is collected in the expansion chamber 38.

The housing 14 preferably includes a vertical baffle wall 44 extending intermediately through the expansion chamber 38, as illustrated in FIG. 4. The wall 44 has at least one opening 46 through which liquid coolant and vapor can flow. The wall 44 has been found to effectively de-aerate coolant in the expansion chamber 38.

The expansion chamber 38 contains a volume of vapor, permitting volume variations of the coolant. Also, in the illustrated embodiment, the expansion chamber 38 additionally functions as a make-up reservoir to contain an extra quantity of liquid coolant. If liquid coolant is lost from the cooling circuit, the coolant contained in the expansion chamber 38 simply gravitates downwardly to maintain a sufficient quantity of circulating coolant. Ideally, the coolant waterline is somewhere between the top and bottom of the expansion chamber 38, as shown in FIG. 5. A filler cap 48 and pressure-release mount 50 are shown in FIG. 2 located at a top of the expansion chamber 38, through which coolant may be added.

Figure 6:
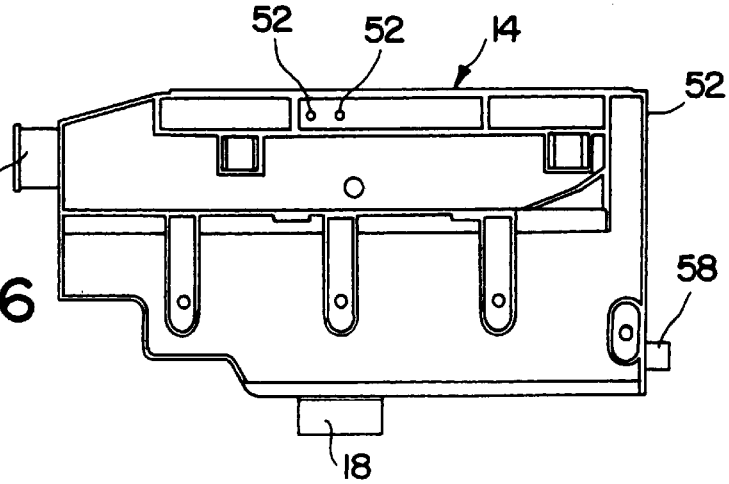
FIG. 6 is an elevation of the integral housing from an opposite side of the view of FIG. 3.

As illustrated in the embodiment of FIG. 6, the expansion chamber 38 includes at least one vent 52, which opens through the housing 14 to deliver vented flow from remote engine components, such as a turbocharger 56 (FIG. 1) and a jacketed exhaust manifold. The vents 52 are connectable to vent tubes at an exterior of said housing 14, these vent tubes being in communication with the respective remote components.

The vents 52 are configured to divert the vent flow from a "high" spot or place in coolant channel of the remote engine component where vapor tends to collect, depending on shape of the cavity within the cooling jacket at that location. A vent tube is mounted between such a vapor-collecting location and the expansion tank 38 via one of the vents 52, diverting a small "vent" flow of coolant and vapor bubbles to the expansion tank 38. This vent flow typically has a relatively low flow rate compared to a main coolant flow through the component.

The vent flows entering the expansion chamber 38 through the vents 52 are indicated by arrows V1 and V2 in FIG. 4. Any vapor bubbles present in the vent flows V1 and V2 are dissipated into the vapor volume of the expansion chamber 38, while the liquid coolant from the vent flows V1 and V2 is free to pass through the opening 46 in the intermediate baffle wall 44 of the expansion chamber 38, eventually reentering the coolant flow in channel C, dropping through the passage 42 into the lower collection chamber 40, and recirculating through the cooling circuit.

Figure 3:
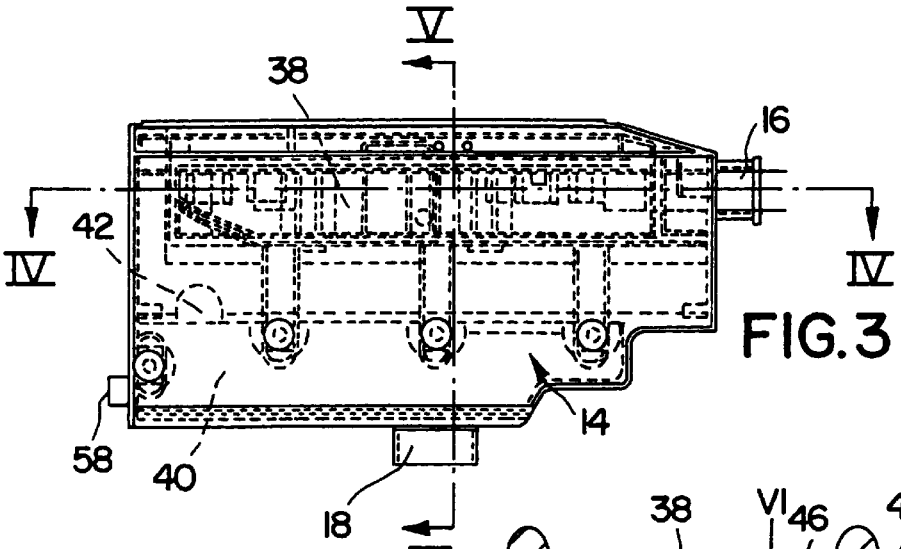
FIG. 3 is a side elevation of an integral housing of a combination heat exchanger and expansion tank according to an embodiment of the present invention.

As shown in FIGS. 3, 5 and 6, an auxiliary coolant inlet 58 may optionally be provided in the housing 14 through which coolant flow from the cooling circuit may enter the collection chamber 40, instead of entering the housing through the main inlet duct 16. Particularly, such an auxiliary inlet 58 may be useful for directing coolant flow from the turbocharger 56.

The coolant which collects in the lower collection chamber 40 exits the housing 14 through outlet duct 18, which is preferably located at a bottom of the collection chamber 40, as shown in FIG. 6.

It should be understood that various changes and modifications to the preferred embodiments will be apparent to those skilled in the art. For example, the term "seawater" is used herein, but fresh water, or another fluid cooling medium could be used instead. Such apparent changes and modifications may be made without departing from the spirit and scope of the present invention and without diminishing its attendant advantages. Therefore, the appended claims are intended to cover such changes and modifications.

What is claimed is:

1. An integrated heat exchanger and expansion tank device having an integral housing, the device comprising;

an expansion chamber formed in an upper portion of said integral housing;

a coolant reservoir for collecting coolant, the reservoir having a volume defined along a lower portion of the housing;

a heat exchanger core mounted within said housing above the reservoir and at least partially below the expansion chamber;

a coolant channel substantially surrounding an exterior of said heat exchanger core, said channel being in fluid communication with said expansion chamber and with said reservoir, said housing including a wall substantially separating said coolant reservoir from said coolant channel;

at least one vent which opens into said expansion chamber, said vent adapted to deliver a vented flow of coolant into said expansion chamber from outside of said housing;

a main coolant inlet duct which opens into said coolant channel adjacent said core to supply a main flow of coolant into said coolant channel; and a passage extending through said wall disposed below said core and opening downwardly into said reservoir to guide said main flow of coolant that downwardly through the passage into said reservoir, said volume of said reservoir occupying; and a coolant outlet duct located at a bottom of said reservoir to guide an exit flow of collected coolant from said device.

2. An integrated heat exchanger and expansion tank device according to claim 1, wherein said core is mounted in said housing in a generally horizontal manner, and wherein said main coolant inlet duct and said passage are located generally at opposite ends of said core.

3. An integrated heat exchanger and expansion tank device according to claim 1, wherein said core is mounted in said housing in a generally horizontal manner, and wherein said main coolant inlet duct and said passage are located generally at opposite ends of said core.

4. An integrated heat exchanger and expansion tank device according to claim 1, comprising two of said vents, one of said vents adapted to deliver vented coolant flow from a turbocharger and another adapted to deliver vented coolant flow from an exhaust manifold.

5. An integrated heat exchanger and expansion tank device according to claim 1, wherein said expansion chamber includes at least one generally vertical baffle wall extending intermediately through said expansion chamber, said wall having at least one opening in communication with said coolant channel.

6. An integrated heat exchanger and expansion tank device according to claim 1, wherein said core has an interior containing at least one generally straight seawater passage, said core being mountable in an end-to-end manner between two external openings in the housing, and wherein said device further comprises two caps respectively securable over said external openings.

7. An integrated heat exchanger and expansion tank device according to claim 6, wherein one of said caps includes a seawater inlet port and a seawater outlet port in communication with said interior of said core.

8. An integrated heat exchanger and expansion tank device according to claim 1, further comprising a coolant inlet duct opening into said lower reservoir.

9. An integrated heat exchanger and expansion tank device according to claim 1, further comprising a plurality of bolt tubes extending transversely through said integral housing.

10. An integrated heat exchanger and expansion tank according to claim 1, wherein the tank is configured to maintain a level of coolant to have a waterline vertically within said expansion chamber.

11. A de-aerating heat exchanger and expansion tank device having an integral housing, comprising;

a heat exchanger core;

an expansion chamber positioned at least partially above said heat exchanger core;

a coolant channel configured to guide a main flow of engine coolant across said heat exchanger core, an upper portion of said channel being in communication with said expansion chamber so that vapor in said channel upwardly collects in said expansion chamber;

at least one vent which opens into said expansion chamber to deliver a vented flow of coolant and vapor into said expansion chamber from externally of said device, such that liquid coolant from the vented flow passes downwardly from said expansion chamber into said channel;

a reservoir for collecting coolant positioned below said heat exchanger core, said reservoir having a volume defined by said housing which extends generally horizontally under at least a portion of a length of said coolant channel, said housing including a generally horizontal wall that substantially separates said reservoir from said coolant channel;

a passage through said wall to guide a flow of liquid coolant from said coolant channel downwardly to collect in said reservoir; and an outlet duct for delivering an exit flow of said collected liquid coolant from said heat exchanger.

12. A de-aerating heat exchanger and expansion tank device according to claim 11, wherein said expansion chamber is defined by a plurality of vertical walls, at least one of said walls having an opening in fluid communication with said coolant channel.

13. A de-aerating heat exchanger and expansion tank device according to claim 11, wherein said core has two opposite ends, said device further comprising:

a coolant inlet delivering engine coolant into said channel near one end of said core; and a passage in said channel near an opposite end of said core through which coolant drops into the reservoir.

14. A de-aerating heat exchanger and expansion tank device according to claim 11, wherein said channel is formed within a housing, the core being mounted in an end-to-end manner between two openings in said housing so that opposite ends of said core are respectively accessible through said openings.

15. A marine engine heat exchanger comprising:

an integral housing;

a heat exchanger core positioned within said housing, an interior of said core containing at least one generally straight, elongated seawater channel;

a coolant channel at least partially defined by a space within said housing substantially surrounding an exterior of said core;

first and second openings in said housing providing access to opposite ends of said seawater channel;

a coolant reservoir for collecting coolant having a volume defined by said housing below said coolant channel, said housing defining a wall extending substantially along a length of said reservoir between said reservoir and said coolant channel, said wall including a passage which opens downwardly from said core to said reservoir to accommodate a flow of coolant from said coolant channel to collect in said reservoir; and an outlet duct at a bottom of said reservoir to guide a flow of coolant away from said heat exchanger.

16. A marine engine heat exchanger according to claim 15, further comprising:

a pair of caps respectively securable over said first and second openings.

17. A marine engine heat exchanger according to claim 16, wherein one of said caps includes a seawater inlet port and a seawater outlet port in communication with said interior of said core.

18. A marine engine heat exchanger according to claim 17, further comprising:

an expansion chamber formed in said housing at least partially above said core, said expansion chamber in communication with said coolant channel.

19. A marine engine heat exchanger according to claim 18, further comprising:

a vent in said expansion chamber adapted to deliver a vented coolant flow from a remote location externally of said ho using into said chamber.

20. A marine engine heat exchanger according to claim 15, further comprising:

a baffle wall extending intermediately through said expansion chamber.

* * * * *